US005736286A

United States Patent [19]

Kaneko et al.

[11] Patent Number: 5,736,286

[45] Date of Patent: Apr. 7, 1998

[54] METHOD FOR RECYCLING IMAGE-DEPOSITED RECORDING MATERIAL AND LIQUID COMPOSITION FOR USE WITH THE RECYCLING METHOD

[75] Inventors: Tetsuya Kaneko, Yokohama; Kakuji Murakami, Kamakura; Kiyofumi Nagai, Machida, all of Japan

[73] Assignee: Ricoh Company, Ltd., Tokyo, Japan

[21] Appl. No.: 441,615

[22] Filed: May 15, 1995

[30] Foreign Application Priority Data

May 16, 1994 [JP] Japan ..... 6-125710
Jun. 21, 1994 [JP] Japan ..... 6-162856

[51] Int. Cl.[6] ..... G03G 13/00

[52] U.S. Cl. ..... 430/97; 430/125; 134/19; 134/42

[58] Field of Search ..... 430/97, 125; 134/19, 134/42; 355/307

[56] References Cited

U.S. PATENT DOCUMENTS 5,474,617 12/1995 Saito et al. ..... 430/125 X

FOREIGN PATENT DOCUMENTS 56-35136 4/1981 Japan ..... 430/97
62-89643 10/1994 Japan ..... 430/97
718827 2/1980 U.S.S.R. ..... 430/125

OTHER PUBLICATIONS

Research Disclosure, Jun. 1973, p. 85.

Xerox Discl. Jour., vol. 19, No. 4, Jul./Aug. 1994, p. 327.

*Primary Examiner*—Roland Martin

*Attorney, Agent, or Firm*—Oblon, Spivak, McClelland, Maier & Neustadt, P.C.

[57] ABSTRACT

A method for recycling an image-deposited recording material having a surface portion which swells in contact with a water-containing liquid composition and bears thereon deposited images containing a thermoplastic or thermofusible image-constituting material is disclosed, which method includes the steps of applying the water-containing liquid composition to the image-deposited surface portion of the recording material to cause the surface portion of the recording material to swell more than the image-constituting material, thereby weakening the adhesion between the deposited images and the recording material; and removing the deposited images from the recording material. The image removal promoting liquid contains a wetting agent which exhibits an equilibrium moisture content of 10% or more under the ambient conditions of 60% relative humidity and 25° C.

6 Claims, 1 Drawing Sheet

METHOD FOR RECYCLING IMAGE-DEPOSITED RECORDING MATERIAL AND LIQUID COMPOSITION FOR USE WITH THE RECYCLING METHOD

BACKGROUND OF THE INVENTION

1. Field of the Invention

The present invention relates to a method for recycling a recording material comprising at least a surface portion which swells in contact with a water-containing liquid composition, and bears thereon deposited images comprising a thermoplastic or thermofusible image-constituting material by the electrophotographic process, thermal transfer recording process, ink-jet process employing a hot-melt ink or other printing processes. In particular, the present invention relates to a method for recycling a toner-image-deposited recording material formed by the electrophotographic method using a dry toner. The present invention also relates to a water-containing liquid composition for promoting the removal of images deposited on the recording material in the above-mentioned recycling method.

This water-containing liquid composition will also be referred to as an image removal promoting liquid.

2. Discussion of Background

Because of rapid development of office automation (OA), printers and copying machines employing various kinds of image forming processes such as an electrophotographic method, thermal transfer recording method or ink-jet method using a hot-melt ink have widely spread. With the spread of the printers and copying machines, however, a large quantity of papers have been used and consumed. This has caused the problems of the environmental disruption of the earth due to deforestation because papers generally used as recording materials contain pulp as a raw material. In addition, with the increase of consumption of such recording materials, the problem of waste treatment has become serious.

Conventionally, in order to solve the above problems, used papers are collected and subjected to beating again to recycle such recording materials. However, the energy efficiency is low in this recycling method, with the result that the cost may become higher as compared with the case where the papers are made of new raw materials, or the quality of the recording materials obtained by the above-mentioned recycling method is lowered.

Recently, there have been developed recording materials which an be repeatedly used for copying or printing operation by cleaning deposited images once formed on the recording materials. For example, as disclosed in Japanese Laid-Open Patent Application 1-297294, images are formed on a recording material such as a sheet made of plastics, metals or ceramics, or a sheet of paper into which liquids hardly penetrate. According to this application, the images deposited on the recording material can be removed therefrom by bringing a thermofusible image release member into contact with the image-deposited recording material with the application of heat thereto, whereby the deposited images are peeled from the recording material.

Furthermore, there is proposed a sheet-shaped image-bearing member capable of being repeatedly used, as disclosed in Japanese Laid-Open Patent Application 4-67043. One side of this image-bearing sheet is made releasable, and the sheet is disinguished from a plain copy paper by marking the sheet.

In those recycling methods, however, not only plain copy papers cannot be used as the recording materials, but also a recording material with poor image-fixing properties has to be selected or a recording material has to be subjected to releasing treatment although the removal of the deposited images from the recording material can be facilitated. Namely, easy peeling of the images from the recording material means insufficient fixing performance of the recorded images. Therefore, when the images deposited on the recording material are rubbed by the clothes or the fingers, the images easily fall off the recording material and the clothes and fingers are stained with the image-constituting material.

There is proposed a method for recycling a recording material on which images are deposited by the electrophotographic process, as disclosed in Japanese Laid-Open Patent Applications 1-101576 and 1-101577. According to this method, a toner-image-bearing recording material is immersed into an organic solvent in which the toner is soluble, and is then subjected to an ultrasonic wave treatment, thereby removing toner images from the recording material. However, this method has the shortcomings that the organic solvents used cause the environmental pollution, and are ignitable and toxic, accordingly not suitable for office or home use. Further, this recycling method is achieved by dissolving the toner in a solvent, so that the solvent is contaminated with the toner in a short period of time. Therefore, a large quantity of solvent is required. In addition, there is the problem that the toner component once dissolved in the solvent is again deposited to the surface of the recording material to induce the toner deposition. It is very difficult to solve such problems.

To solve the aforementioned problems, the inventors of the present invention have proposed a method for recycling a recording material which bears toner images thereon by the electrophotographic process, as disclosed in Japanese Laid-Open Patent Application 5-202557, not having the above-mentioned conventional special papers. This recycling method comprises the steps of impregnating the toner-image-bearing recording material with a water-containing liquid composition, that is, a water-containing image removal promoting liquid; bringing an image release member into contact with the image-bearing surface of the recording material with the application of heat thereto; and removing the toner images from the recording material.

However, the storage stability of the conventional image removal promoting liquid used in the above-mentioned recycling method is poor. To be more specific, the composition of the image removal promoting liquid tends to change with the evaporation of the water content of the image removal promoting liquid, and other components than water may finally separate out when a large amount of water is caused to evaporate.

Furthermore, the evaporation of the water component of the image removal promoting liquid during the heating step of the image removal procedure has a serious effect on the image removal performance in the above-mentioned recycling method. Therefore, when the kind of recording material or the kind of image-constituting material to be employed is different, it is difficult to produce the same results of image removal performance although the same apparatus is employed under the same conditions.

SUMMARY OF THE INVENTION

It is therefore a first object of the present invention to provide a method for recycling a recording material on which images are deposited in the form of a film by a variety of image forming methods such as an electrophotographic process, thermal transfer recording process and ink-jet process using a hot-melt ink, by removing the deposited images from the recording material using an image removal promoting liquid capable of exhibiting improved image removal performance, and good storage stability so as to exhibit the same image removal performance after the storage of the image removal promoting liquid.

A second object of the present invention is to provide the above-mentioned image removal promoting liquid with improved image removal properties and good storage stability for use with the method for recycling the image-deposited recording material.

The above-mentioned first object of the present invention can be achieved by a method for recycling a recording material comprising a surface portion which swells in contact with a water-containing image removal promoting liquid and bears thereon deposited images comprising a thermoplastic or thermofusible image-constituting material, comprising the steps of applying the water-containing image removal promoting liquid the image-deposited surface portion of the recording material to cause the surface portion of the recording material to swell more than the image-constituting material, thereby weakening the adhesion between the deposited images and the recording material; and removing the deposited images from the recording material by using image release means, with the image removal promoting liquid comprising a wetting agent which exhibits an equilibrium moisture content of 10% or more under the ambient conditions of 60% relative humidity and 25° C.

The second object of the present invention can be achieved by a liquid composition for promoting the removal of images deposited on a recording material comprising a surface portion which swells in contact with the above-mentioned liquid composition and bears thereon deposited images comprising a thermoplastic or thermo-fusible image-constituting material, which liquid composition comprises water and a wetting agent capable of exhibiting an equilibrium moisture content of 10% or more under the ambient conditions of 60% relative humidity and 25° C.

It is preferable that the wetting agent or use in the liquid composition, namely, the image removal promoting liquid comprise at least one compound selected from the group consisting of a polyhydroxy alcohol, and an alkyl ether derivative and an aryl ether derivative thereof; a carboxylic acid with hydroxyl group, and a salt thereof; and a nitrogen-containing heterocyclic compound.

The amount of the wetting agent is preferably in a range of 0.5 to 60 wt. % of the total weight of the image removal promoting liquid.

It is preferable that the image removal promoting liquid further comprise a surfactant and/or a water-soluble polymer.

Furthermore, it is preferable that the penetrating rate of the image removal promoting liquid into the image-deposited recording material be controlled to 10 ml/m$^2$ or more provided that the contact time (t) of the image removal promoting liquid with the recording material is 0.4 sec.

In addition, it is preferable that the deposited images be removed from the recording material in a temperature range from the softening point of the image-constituting material or more to a temperature less than the melting point thereof.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
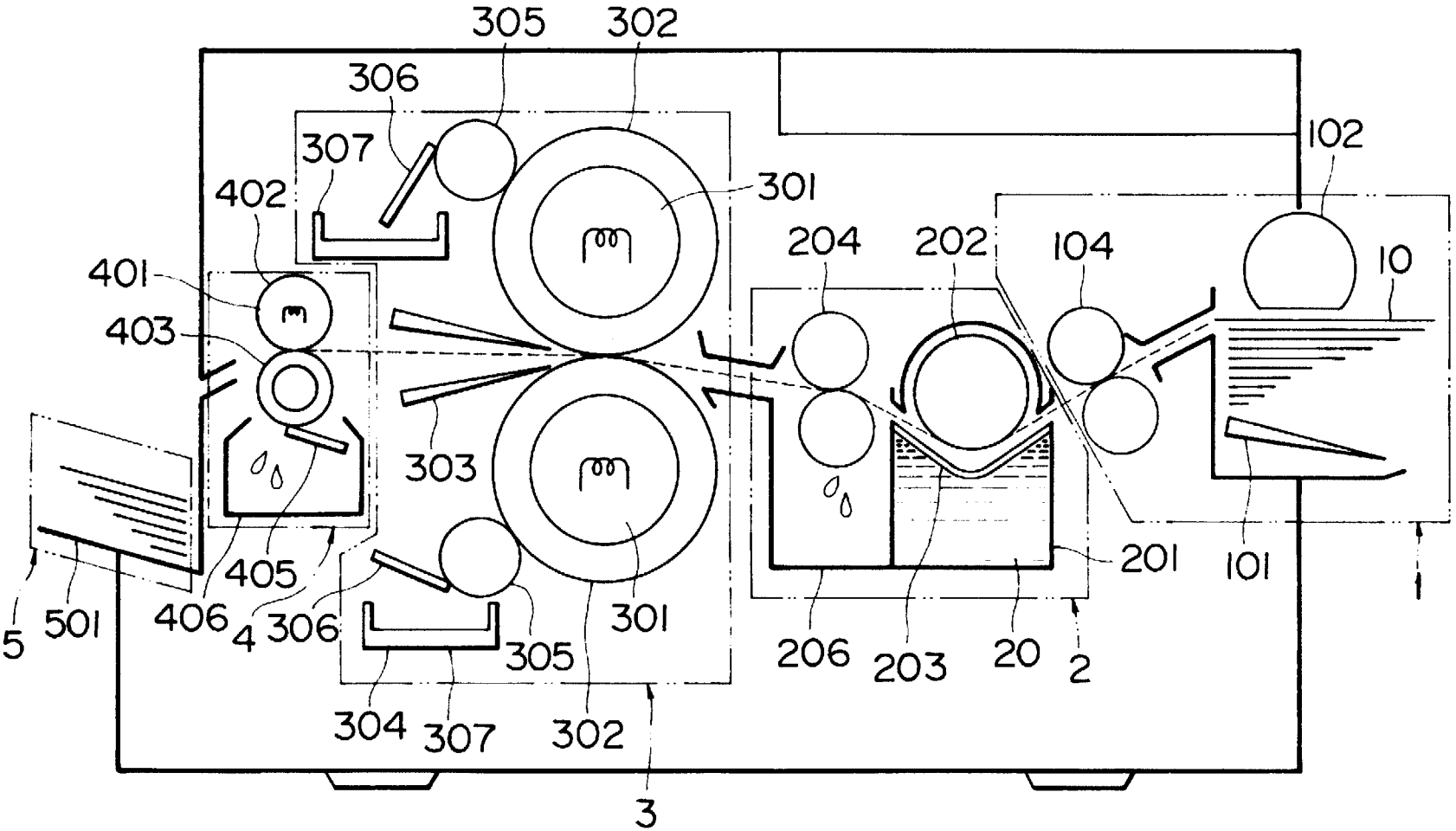
FIG. 1 is a schematic view of an apparatus for recycling an image-deposited recording material for use with the recycling method of the present invention.

To obtain a so-called hard copy on a recording material, there are conventionally proposed many methods; for example, the electrophotographic process using a dry or liquid toner, the thermal transfer recording process using a thermofusible ink sheet, the thermal diffusion transfer recording process using a thermally diffusing dye, the ink jet process using a hot-melt ink, and various printing processes such as offset printing, intaglio printing, letterpress printing and stencil printing. The image-constituting material is deposited in the form of a film on the surface portion of a recording material by the above-mentioned electrophotographic process, thermal transfer recording process, ink jet process, and other conventional printing processes. In this case, the whole image may not necessarily be constituted by a continuous film. The image in the form of a film means that the image-constituting material does not deeply permeate through the recording material in the thickness direction thereof, or the image-constituting material is not adsorbed substantially on the molecular level by the recording material unlike an image-constituting material such as a dye-containing water-soluble ink. For instance, when toner images are formed on a recording material by the electrophotographic process using a dry toner in such a fashion that toner particles do not penetrate through the inside of the recording material even though one character image is dotted and toner particles are independently deposited on the recording material, it is believed that those toner images can be removed from the recording material by the recycling method according to the present invention.

According to the present invention, there is provided a method for recycling a recording material which comprises at least a surface portion capable of swelling in contact with a water-containing image removal promoting liquid, on the surface portion images comprising a thermoplastic or thermofusible image-constituting material being deposited. According to the recycling method of the present invention, the image-deposited surface portion of the recording material is impregnated with the water-containing image removal promoting liquid. In this case, the surface portion of the recording material swells more than the image-constituting material when coming in contact with the water-containing image removal promoting liquid of the present invention, so that the adhesion between the deposited images and the surface portion of the recording material is weakened owing to the difference between the swelling of the image-constituting material and that of the surface portion of the recording material. Then, the deposited images are removed from the recording material using appropriate image release means.

As the recording material for bearing images thereon, any recording material can be used so long as the recording material comprises a least an image-bearing surface portion comprising a material capable of swelling in contact with a water-containing image removal promoting liquid. For example, paper mainly comprising cellulose fibers, such as copy paper and printing paper can be used. Furthermore, there can be employed a laminated material composed of a plastic layer and a paper layer. The image-bearing surface portion of the recording material is not limited to the paper layer comprising cellulose fibers. Furthermore, by adding the particles of a gelatinizing agent for water, for example, crosslinked polyacrylate, polyvinyl alcohol, polyacrylamide, or cellulose resin such as carboxymethylcellulose to a material for use in the surface portion of the recording material, there can be obtained a surface portion capable of swelling in contact with the water-containing image removal promoting liquid.

In general, when a recording material comprising a surface layer which swells in contact with water is impregnated with an aqueous solution, the surface layer of the recording material undergoes some changes, and is liable to be affected by external force. This phenomenon can be recognized by the daily experience that a sheet of paper easily gets torn or a surface layer of paper is easily peeled off when wetted with water. In the present invention, although the surface portion of the recording material is liable to be affected by the external force when the image-removal promoting liquid is applied thereto, the deposited images can be removed from the recording material without impairing the surface portion thereof. This is because the adhesion between the deposited images and the surface portion of the recording material can be considerably decreased by the application of the water-containing image removal promoting liquid the image-deposited recording material.

It is necessary that the image removal promoting liquid have the properties that it can hardly dissolve the image-constituting material therein or it can hardly cause the image-constituting material to swell when coming in contact with the image-constituting material, but can cause the surface portion of the recording material to swell. In light of safety, cost and the above-mentioned properties required for the image removal promoting liquid, the image removal promoting liquid of the present invention comprises water as the main component. However, as previously mentioned, the storage stability of the conventional water-containing image removal promoting liquid is poor because the water component of the image removal promoting liquid evaporates during the intermission of the recycling process. In addition, the image-constituting material which has been substantially peeled from the recording material and transferred to an image release member may be again deposited to the recording material with the evaporation of the water component of the image removal promoting liquid while the deposited images are removed from the recording material with the application of heat thereto.

To solve the above-mentioned problems, the image removal promoting liquid according to the present invention comprises a wetting agent which exhibits an equilibrium moisture content of 10% or more under the ambient conditions of 60% relative humidity and 25° C. Therefore, the composition of the image removal promoting liquid can be prevented from changing and some components contained in the liquid can be prevented from separating out even though the image removal promoting liquid is allowed to stand during the intermission of recycling process. Thus, the storage stability of the image removal promoting liquid of the present invention can be improved. Furthermore, the evaporation of water content of the image removal promoting liquid can be prevented even when the heat energy is applied to the image removal promoting liquid during the image removal process, so that the image removal properties of the image removal promoting liquid can be improved.

It is desirable that the wetting agent for use in the image removal promoting liquid of the present invention have high solubility in water and water absorption properties.

It is preferable that the wetting agent for use in the image removal promoting liquid comprise at least one compound selected from the group consising of a polyhydroxy alcohol, and an alkyl ether derivative and an aryl ether derivative thereof a carboxylic acid with hydroxyl group, and a salt thereof and a nitrogen-containing heterocyclic compound. When such a wetting agent is employed in the image removal promoting liquid of the present invention, the storage stability of the liquid composition and the image removal efficiency can be remarkably improved.

Specific examples of the wetting agent include polyhydroxy alcohols such as ethylene glycol, diethylene glycol, triethylene glycol, tetraethylene glycol, propylene glycol, dipropylene glycol, polyethylene glycol and glycerin alkyl ether derivatives of the polyhydroxy alcohols such as ethylene glycol monomethyl ether, ethylene glycol monoethyl ether, diethylene glycol monoethyl ether, diethylene glycol monobutyl ether, diethylene glycol dimethyl ether, diethylene glycol methyl ethyl ether, and triethylene glycol monomethyl ether; aryl ether derivatives of the polyhydroxy alcohols such as ethylene glycol monophenyl ether; carboxylic acids with hydroxyl group such as lactic acid and malic acid, and salts thereof; and nitrogen-containing heterocyclic compounds such as N-methyl-2-pyrrolidone and 2-pyrrolidone. These compounds may be used in combination.

The content of the wetting agent in the image removal promoting liquid is an important factor to determine the viscosity of the image removal promoting liquid. When the viscosity of the image removal promoting liquid is increased by the increase of the content of the wetting agent, it is difficult to supply the image removal promoting liquid to the image-deposited recording material. To be more specific, when the image removal promoting liquid is applied to the recording material by non-contact method, it becomes considerably difficult to control the application of the image removal promoting liquid to the image-deposited recording material with the increase of viscosity of the liquid composition. In the case where the image removal promoting liquid with high viscosity is supplied to the image-deposited recording material in such a manner that a member for applying the image removal promoting liquid to the recording material is brought into contact with the image-deposited recording material, the surface of the recording material may be impaired. In light of the viscosity of the image removal promoting liquid, it is preferable that the amount of the wetting agent be in a range of 0.5 to 60 wt. %, more preferably in a range of 1 to 40 wt. %, of the total weight of the image removal promoting liquid.

The image removal promoting liquid of the present invention may further comprise a surfactant to achieve the image removal in good condition. The surface tension of the image removal promoting liquid can be decreased by the addition of the surfactant, so that the wettability of the image-constituting material and the recording material by the image removal promoting liquid can be improved. It is preferable that the amount of the surfactant be in a range of 0.01 to 20 wt. %, more preferably in a range of 0.1 to 5 wt. %, of the total weight of the image removal promoting liquid.

Any surfactants with good dispersion properties or high solution stability in water can be preferably added to the image removal promoting liquid.

Specific examples of the anionic surfactant for use in the present invention are carboxylates such as soap, N-acylamino acid salt, alkyl ether acetate and acylated peptide; sulfonates such as alkyl sulfonate, alkylbenzenesulfonate, alkylnaphthalenesulfonate, sulfouccinate, α-olefinsulfonate and N-acyl sulfonate; sulfuric ester salts such as sulfated oil, alkylsulfate, alkyl ether sulfate and alkylamide sulfate; and phosphoric ester salts such as alkyl phosphate, alkyl ether phosphate and alkylaryl phosphate.

Specific examples of the cationic surfactant are aliphatic amine salts, alkyl quaternary ammonium salts, aromatic quaternary ammonium salts, and heterocyclic quaternary ammonium salts.

Specific examples of the amphoteric surfactant are betaines such as carboxybetaine and sulfobetaine; amino carboxylate; and imidazoline derivatives.

Specific examples of the nonionic surfactant are ether-based surfactants such as polyoxyethylene alkyl ether, polyoxyethylene aryl ether, polyoxyethylene styrol ether, polyoxyethylene lanolin derivatives, ethylene oxide derivatives of alkylaryl formaldehyde condensate, polyoxyethylene polyoxypropylene block polymer and polyoxyethylene polyoxypropylene alkyl ether; ether-ester-based surfactants such as polyoxyethylene glycerin fatty ester, polyoxyethylene sorbitan fatty ester and polyoxyethylene sorbitol fatty ester; ester-based surfactants such as polyethylene glycol fatty ester, fatty acid monoglyceride, polyglycerin fatty ester, sorbitan fatty ester, propylene glycol fatty ester and sucrose fatty ester; and nitrogen-containing surfactants such as aliphatic alkanolamide, polyoxyethylene fatty amide, polyoxyethylene alkyl amine and alkylamine oxide.

Examples of the fluorine-containing surfactants include anionic surfactants such as fluoroalkyl carboxylate and fluoroalkyl sulfonate; amphoteric surfactants such as fluoroalkyl-introduced betaine; and other nonionic and cationic fluorine-containing surfactants.

Examples of the silicone surfactants are polyoxyalkylene-modified siloxane and carboxylated-polyoxyalkylene-modified siloxane.

Those surfactants may be used alone or in combination.

The image removal promoting liquid of the present invention may further comprise a water-soluble polymer to improve the image removal performance and increase the quality of the recording material obtained after the recycling process.

Examples of the water-soluble polymer for use in the image removal promoting liquid are as follows:

1. Natural polymers: plant polymers such as gum arabic, tragacanth gum, guar gum, karaya gum, locust-bean gum, arabinogalactan, pectin and quince seed starch; seaweed polymers such as alginic acid, carrageenan, agar and glue plant; animal polymers such as gelatin, casein, albumin, collagen and shellac; and microorganism polymers such as xanthane gum and dextran.
2. Semisynthesized polymers: cellulose polymers such as methyl cellulose, ethyl cellulose, hydroxyethyl cellulose, hydroxypropyl cellulose and carboxymethyl cellulose; starch polymers such as soluble starch, carboxymethyl starch (CMS), dialdehyde starch, sodium starch glycolate and sodium starch phosphate; and seaweed polymers such as sodium alginate and propylene glycol alginate.
3. Synthesized polymers: vinyl polymers such as polyvinyl alcohol, polyvinyl pyrrolidone and polyvinyl methyl ether; acrylic resins such as non-crosslinked polyacrylamide, polyacrylic acid and alkali metal salts thereof, and water-soluble styrene acrylic resin; and water-soluble styrene maleic resin, water-soluble vinylnaphthalene acrylic resin, water-soluble vinylnaphthalene maleic resin, polyvinyl pyrrolidone, polyvinyl alcohol, alkali metal salts of β-naphthalenesulfonic acid formalin condensate, and polymers of which side chain has a salt with a cationic functional group such as quaternary ammonium or amino group.

The amount of the water-soluble polymer, which depends on the method of applying the image removal promoting liquid to the image-deposited recording material, is preferably in a range of 0.1 to 20 wt. %, more preferably in a range of 0.1 to 10 wt. % of the total weight of the image removal promoting liquid.

When the water-containing image removal promoting liquid of the present invention comprises a surfactant and a water-soluble polymer, the water-soluble polymer serves as an intermediate release member when the deposited images are removed from the recording material. To be more specific, the image-constituting material adhering to the inside of cellulose fibers, which cannot come into direct contact with the image release member, can be removed from the cellulose fibers because the water-soluble polymer can be brought into contact with the image-constituting material adhering to the cellulose fibers. Owing to the viscosity of the water-soluble polymer the image-constituting material can be attached to the water-soluble polymer and transferred to the image release member together when the image release member is brought into contact with the water-soluble polymer. The image can be thus removed from the cellulose fibers without impairing the quality of the paper.

The image removal promoting liquid of the present invention may further comprise a pH controlling agent. Any pH controlling agent that can adjust the image removal promoting liquid to pH 7 to pH 11 and has no bad influence on the image removal promoting liquid can be freely employed.

Specific examples of the pH controlling agent for use in the present invention include amines such as diethanolamine and triethanolamine; hydroxides of alkali metals such as lithium hydroxide, sodium hydroxide and potassium hydroxide; hydroxides such as ammonium hydroxide, quaternary ammonium hydroxide and quaternary phosphonium hydroxide; and carbonates of alkali metals such as lithium carbonate, sodium carbonate and potassium carbonate.

Furthermore, the image removal promoting liquid may further comprise a chelating agent, an antiseptic and antimould agent, an anti-corrosive agent, and a bleaching agent.

The chelating agent for use in the image removal promoting liquid serves as a sequestering agent. Examples of the chelating agent for use in the present invention are sodium ethylenediaminetetraacetate, sodium nitrilotriacetate, sodium hydroxyethyl ethylenediaminetriacetate, sodium diethylenetriaminepentaacetate, and sodium uramil diacetate.

Examples of the antiseptic and antimould agent for use in the image removal promoting liquid are sodium dehydroacetate, sodium sorbate, 2-pyridinethiol-1-oxide sodium, sodium benzoate, and pentachlorophenol sodium.

Examples of the anti-corrosive agent for use in the image removal promoting liquid are acid sulfite, sodium thiosulfate, ammonium thiodiglycolate, diisopropyl ammonium nitrite, pentaerythritol tetranitrate, and dicyclohexyl ammonium nitrite.

The bleaching agent may be added to the image removal promoting liquid to improve the degree of whiteness of the recording material after recycling process. For example, there can be employed oxidation bleaching agents such as hydrogen peroxide, sodium peroxide, sodium percarbonate, and sodium hypochlorite. In addition, a fluorescent dye, a bluing dye and an enzyme may be used in combination.

It is preferable that the contact angle of the image removal promoting liquid with the image-constituting material deposited on the recording material be 90° or less, more preferably 50° or less. Further, it is preferable that the surface tension of the image removal promoting liquid be 70 mN/m (dyne/cm) or less, more preferably 50 mN/m or less.

The penetrating rate of the image removal promoting liquid into the image-deposited recording material may be controlled to 10 ml/m$^2$ or more, more preferably 12 ml/m$^2$ or more provided that the contact time (t) of the image removal promoting liquid with the recording material is 0.4 sec.

After the image-deposited surface portion of the recording material is impregnated with the previously mentioned image removal promoting liquid of the present invention to weaken the adhesion between the image-constituting material and the surface portion of the recording material, the images can be removed from the recording material by various methods. For instance, the deposited images may be scraped off the surface portion of the recording material with a scraping member such as a brush with fibers made of a metal or synthesized or natural polymer, or a blade made of a rubber, plastic material or metal. Alternatively, the deposited images may be removed from the recording material by causing a gas to blow off the images or spraying a liquid onto the image-deposited surface portion. In this case, the gas or liquid may contain sand, clay, emery or titanium oxide. Furthermore, the image-constituting material may be shaken down from the recording material by repeatedly bending the recording material or by applying some vibration to the recording material. In addition, the image-deposited recording material may be brought into contact with an image release member with adhesion properties, such as an adhesive tape, to cause the image-constituting material to transfer to the image release member, or the image-deposited recording material may be brought into pressure contact with an image release member. The image-constituting material may be electrostatically stripped from the recording material, or may be removed therefrom under reduced pressure.

The images deposited in the form of a film on the recording material comprise a thermoplastic or thermofusible image-constituting material, such as a toner for use with the electrophotographic method or an ink for use with the thermal transfer recording method or hot-melt ink-jet method. As previously explained, the adhesion between the deposited images and the recording material is weakened when the image removal promoting liquid is applied to the image-deposited recording material. This is because the swelling of the deposited image is different from that of the recording material. To remove the previously mentioned image-constituting material from the recording material, an image release member of which adhesion to the image-constituting material is stronger than the adhesion between the image-constituting material and the recording material which has been weakened by the application of the image removal promoting liquid may be brought into contact with the deposited images with the application of heat and/or pressure thereto. This method of removing the deposited images from the recording material has the advantages that the recycling process can be carried out using a remarkably simple apparatus, the surface of the recording material can be prevented from being stained with foreign materials, the environmental pollution can be prevented, the images can be steadily removed from the recording material, and the cost can be decreased. It is necessary to select a material for the image release member so that the adhesion other image release member to the image-constituting material may become stronger than the adhesion between the image-constituting material and the recording material which has been weakened by the application of the image removal promoting liquid.

A variety of polymers, which may be soluble in water or not, and metals such as aluminum and nickel can be used for the material for the image release member.

Specific examples of the polymer used as the material for the image release member are as follows:

(1) Resin components for use in the image-constituting material deposited on the recording material, such as polystyrene, acrylic resin, methacrylic resin, styrene-butyl acrylic copolymer, styrene-butadiene copolymer, polyester and epoxy resin.

(2) Resin Components for use in adhesive agents, for example, resin components for protein-based adhesives such as glue, gelatin, albumin and casein; resin components for carbohydrate-based adhesives such as starch, cellulose and complex polysaccharide (including gum arabic and gum tragacanth); resin components for thermoplastic adhesives such as vinyl acetate polymer and copolymer, acrylic copolymer, ethylenic copolymer, polyamide, polyester and polyurethane; and resin components for rubber-based adhesives such as polychloroprene rubber, nitrile rubber, reclaimed rubber, styrene-butadiene rubber (SBR) and natural rubber.

Furthermore, resins which can be formed into a film, such as polyethylene terephthalate, polycarbonate and polyimide can be used for the image release member.

The above-mentioned resins for the image release member can be employed in such a fashion that they are formed into a sheet, belt, tape or roller. Alternatively, those resins may be provided on the surface of a support member such as a sheet or roller to prepare the image release member. As the embodiment of such an image release member, there can be employed an adhesive tape prepared by providing a rubber-based or acrylic pressure sensitive adhesive agent layer on the support member of cellophane tape, craft-paper tape, polyvinyl chloride tape, acetate tape, or filament-reinforced tape. When the pressure sensitive adhesive agent layer is provided on the surface of the support member, it is preferable that the surface of the support member be porous or be made of a material comprising minute convex and concave portions. Alternatively, the surface of the support member may be surface-treated to have surface roughness or subjected to matte finish. In the case where the image release member is in the form of a sheet, belt or tape, the image release member may be rolled into a ball in advance and rolled out for use in practice.

The image removal promoting liquid of the present invention comprises a wetting agent, so that evaporation of the water content contained in the image removal promoting liquid can be prevented even when the image release member is brought into contact with the deposited images under the application of heat thereto. Accordingly, the surface layer of the recording material can be prevented from peeling off and adhering to the image release member together with the deposited images. Namely, the addition of the wetting agent to the image removal promoting liquid can prevent the deterioration of the surface quality of the recording material after recycling process.

FIG. 1 is a schematic view of an apparatus for use with the method for recycling an image-deposited recording material according to the present invention.

The apparatus as shown in FIG. 1 comprises a paperfeed unit 1, an image removal promoting liquid application unit 2, an image-constituting material peeling-off unit 3, a drying unit 4, and a paper receiving unit 5. In the paper-feed unit 1 of the apparatus of FIG. 1, recording materials 10, each of which bears deposited images thereon, for example, by use of an electrophotographic copying machine, are accumulated on a bottom tray 101 in such a fashion that the image-deposited surface of each recording material 10 is directed to the bottom tray 101. The recording material 10 at the uppermost position on the bottom tray 101 is sent toward the image removal promoting liquid application unit 2 by a paper-feed roller 102. Even if a plurality of recording materials are sent at one-time operation, one sheet of the recording material is separated by a paper separation mechanism (not shown) and the sheet is caused to pass through the gap between a pair of resist rollers 104, with adjusting the paper-feed timing and correcting the skew of the recording material. Such a paper-feed mechanism is the same as that employed in the electrophotographic copying machine.

The image removal promoting liquid application unit 2 is equipped with a container 201 filled at a predetermined level with an image removal promoting liquid 20; a transporting roller 202 for causing the recording material 10 to pass through the image removal promoting liquid 20, with coming into contact with the back surface, that is, opposite to the image-deposited surface of the recording material 10; a driving unit (not shown) for the transporting roller 202; a guide plate 203 for guiding the recording material 10 with bringing the image-deposited surface of the recording material 10 into contact with the image removal promoting liquid 20; and a pair of squeezing rollers 204 which also serves as the transporting rollers for the recording material 10. In addition, reference numeral 206 indicates a reservoir for the image removal promoting liquid.

In the image removal promoting liquid application unit 2, the recording material 10 is caused to pass through the image removal promoting liquid 20 along the guide plate 203, with being moved by the transporting roller 202, so that the image-deposited surface of the recording material 10 is immersed into the image removal promoting liquid 20. Then, an excess amount of the image removal promoting liquid 20 applied to the recording material 10 can be removed therefrom by causing the recording material 10 to pass through a gap between squeezing rollers 204. Thereafter, the recording material 10 is sent to the image-constituting material peeling-off unit 3.

There are situated in the image-constituting material peeling-off unit 3 a pair of image release rollers 302 disposed in pressure contact with each other, each of which has a heat-application lamp therein for softening the image-constituting material deposited on the recording material 10. Further, there are separating claws 303 disposed in contact with the surface of the heat-application image release rollers 302; a cleaning unit 304 for cleaning the surface of the heat-application image release rollers 302; and a driving unit therefor (not shown).

Both sides of the recording material 10 are attached to the upper and lower heat-application image release rollers 302, so that the image-constituting material deposited on the recording material 10 can be softened by the application of heat thereto. Thus, the image-constituting material can be easily peeled from the fibers of the recording material 10. It is desirable to heat the image-constituting material deposited on the recording material 10 by the heat-application image release rollers 302 to such a degree that the image-constituting material is softened, but not fused. If the image-constituting material deposited on the recording material 10 is completely fused, it is difficult to separate the whole image-constituting material from the recording material 10 and transfer the image-constituting material to the lower image release roller 302. In addition, when the surface temperature of the heat-application image release rollers 302 is too high, the recording material 10 becomes too dry while passing through the gap between the heat-application image release rollers 302, and the recording material 10 tends to tightly adhere to the lower heat-application image release roller 302 via the image-constituting material. This will make it impossible to separate the recording material 10 from the heat-application image release roller 302 by the separating claw 303. With such drawbacks taken into consideration, it is preferable to heat the image-deposited recording material 10 to such an extent that the recording material 10 remains still somewhat moist after passing through the heat-application image release rollers 302, so that the image-constituting material which has been transferred to the lower image release roller 302 can be prevented from being deposited to the recording material 10 again.

The cleaning unit 304 is disposed adjacent to each heat-application image release roller 302. Each cleaning unit 302 is equipped with a cleaning roller 305 for removing the image-constituting material from the image release roller 302, a scraper blade 306 for scraping the image-constituting material off the cleaning roller 305, and a container 307 for collecting the image-constituting material scraped off the cleaning roller 305.

In the image-constituting material peeling-off unit 3, there can be employed an image release belt instead of the image release roller 302 as long as the image release belt is provided with the same surface properties as those of the above-mentioned image release roller 302. In addition, a cleaning blade or scraper may be brought into direct contact with the surface of each image release roller 302 instead of the above-mentioned cleaning roller 305 in the cleaning unit 304.

The recording material 10 is then dried in the drying unit 4. The drying unit 4 is equipped with an upper drying roller 402, which is made of, for example, aluminum, and has a heating lamp 401 therein, and a lower drying roller 403 which is urged toward the upper drying roller 402. The lower drying roller 403 comprises a surface layer made of a liquid-absorbing material, and the image removal promoting liquid absorbed by the surface layer of the lower drying roller 403 is squeezed therefrom with a squeezing blade 405 which is in contact with the surface layer of the lower drying roller 403. In addition, reference numeral 406 indicates a reservoir for the collected image removal promoting liquid. Instead of the above-mentioned pair of drying rollers 402 and 403, or in addition to those drying rollers, there can be employed a drying belt, a hot-air fan or an infrared lamp.

There is disposed a paper receiving tray 501 in the paper receiving unit 5 for receiving the recording material 10 after the drying step.

The apparatus for recycling the image-deposited recording material as shown in FIG. 1 is further equipped with various means although not shown in the figure, for example, means for detecting the presence of the recording material 10 on the bottom tray 101; means for detecting whether the single paper is fed from the bottom tray 101 or not; means for detecting the amount of the image removal promoting liquid 20 remaining in the container 201; means for automatically replenishing the container 201 with the image removal promoting liquid 20; means for detecting the occurrence of paper jam; means for controlling the heating lamps 301 and 401; and means for detecting whether the container 307 is filled with the image-constituting material.

Other features of this invention will become apparent in the course of the following description of exemplary embodiments, which are given for illustration of the invention and are not intended to be limiting thereof.

EXAMPLE 1

The following components were mixed in a blender for 10 minutes:

| | Wt. % |
|---|---|
| Polyester resin (binder resin) | 43 |
| Styrene acrylic resin (binder resin) | 43 |
| Cr-containing monoazo dye (charge controlling agent) | 3 |
| Carnauba wax (release agent) | 4 |
| Carbon black (coloring agent) | 7 |

The above prepared mixture was kneaded in a two-roll mill of 120° to 140° C., and then cooled to room temperature. The mixture was roughly ground in a cutter mill, and thereafter pulverized in a pulverizer using a jet air, and subjected to air classification, so that a toner (A) with an average volume particle diameter of 10 μm was obtained.

A mixture the following components was stirred and dissolved, so that an image removal promoting liquid (a) of the present invention was obtained:

| | Wt. % |
|---|---|
| Branched polyoxyethylene alkyl ether based surfactant | 1 |
| Sodium benzoate | 0.1 |
| Diethylene glycol | 20 |
| Pure water | 78.9 |

Using a commercially available electrophotographic copying machine, toner images were formed on a commercially available high quality paper ("PPC Paper type-6200" Trademark, made by Ricoh Company, Ltd.).

The thus obtained toner-image-deposited copy paper was set on the bottom tray 101 of the apparatus as shown in FIG. 1 for recycling the image-deposited copy paper. The toner-image-deposited surface of the copy paper was immersed into the image removal promoting liquid (a). Then, the toner-image-deposited surface of the copy paper was brought into pressure contact with the heat-application image release roller 302 made of polyethylene terephthalate (PET) with the application of heat thereto to cause the deposited toner images to transfer to the image release roller 302. As a result, the copy paper free from deposited toner image was obtained.

In addition, the image removal promoting liquid (a) was allowed to stand for 3 days as it was. Then, toner images were formed on the copy paper and removed therefrom under the same conditions as mentioned above. As a result, image removal was carried out successfully.

When the toner images were again formed on the copy papers obtained by the above-mentioned recycling method, clear toner images were formed on any copy papers with good image-fixing properties.

EXAMPLE 2

The following components were mixed in a blender for 10 minutes:

| | Wt. % |
|---|---|
| Polyester resin (binder resin) | 70 |
| Styrene acrylic resin (binder resin) | 16 |
| Zinc salt of salicylic acid derivative (charge controlling agent) | 3 |
| Carnauba wax (release agent) | 4 |
| Carbon black (coloring agent) | 7 |

The above prepared mixture was kneaded in a two-roll mill of 120° to 140° C., and then cooled to room temperature. The mixture was roughly ground in a cutter mill, and thereafter pulverized in a pulverizer using a jet air, and subjected to air classification, so that a toner (B) with an average volume particle diameter of 8 μm was obtained.

A mixture of the following components was stirred and dissolved, so that an image removal promoting liquid (b) of the present invention was obtained:

| | Wt. % |
|---|---|
| Sodium alginate | 2 |
| Sodium dehydroacetate | 0.1 |
| Triethylene glycol | 10 |
| Pure water | 87.9 |

Using a commercially available electrophotographic copying machine, toner images were formed on a commercially available high quality paper ("PPC Paper type-6200" Trademark, made by Ricoh Company, Ltd.) by the same method as employed in Example 1 except that the toner (A) for use in the copying machine was replaced by the toner (B).

The toner images thus formed on the copy paper were removed therefrom by the same method as employed in Example 1 except that the image removal promoting liquid (a) set in the apparatus in Example 1 was replaced by the image removal promoting liquid (b). As a result, the copy paper free from deposited toner image was obtained.

In addition, the image removal promoting liquid (b) was allowed to stand for 3 days as it was. Then, toner images were formed on the copy paper and removed therefrom under the same conditions as mentioned above. As a result, image removal was carried out successfully.

When the toner images were again formed on the copy papers obtained by the above-mentioned recycling method, clear toner images were formed on any copy papers with good image-fixing properties.

EXAMPLE 3

A mixture of the following components was stirred and dissolved, so that an image removal promoting liquid (c) of the present invention was obtained:

| | Wt. % |
|---|---|
| Polyoxyethylene alkyl ether based surfactant | 1 |
| Potassium benzoate | 0.1 |
| 1,2,3-butanetriol | 15 |
| Pure water | 83.9 |

Using a commercially available electrophotographic copying machine, toner images were formed on a commercially available high quality paper ("PPC Paper type-6200" Trademark, made by Ricoh Company, Ltd.) by the same method as employed in Example 1.

Then, the toner images thus formed on the copy paper were removed therefrom by the same method as employed in Example 1 except that the image removal promoting liquid (a) set in the apparatus in Example 1 was replaced by the image removal promoting liquid (c), and the material for use in the image release roller 302 was changed from PET to polyimide. As a result, the copy paper free from deposited toner image was obtained.

In addition, the image removal promoting liquid (c) was allowed to stand for 3 days as it was. Then, toner images were formed on the copy paper and removed therefrom under the same conditions as mentioned above. As a result, image removal was carried out successfully.

When the toner images were again formed on the copy papers obtained by the above-mentioned recycling method, clear toner images were formed on any copy papers with good image-fixing properties.

EXAMPLE 4

A mixture of the following components was stirred and dissolved, so that an image removal promoting liquid (d) of the present invention was obtained:

| | Wt. % |
|---|---|
| Sodium dioctyl sulfosuccinate | 0.5 |
| Sodium sorbate | 0.1 |
| Sodium lactate | 45 |
| Pure water | 54.4 |

Using a commercially available electrophotographic copying machine, toner images were formed on a commercially available high quality paper ("PPC Paper type-6200" Trademark, made by Ricoh Company, Ltd.) by the same method as employed in Example 2.

Then, the toner images thus formed on the copy paper were removed therefrom by the same method as employed in Example 2 except that the image removal promoting liquid (b) set in the apparatus in Example 2 was replaced by the image removal promoting liquid (d), and the material for use in the image release roller 302 was changed from PET to polycarbonate. As a result, the copy paper free from deposited toner image was obtained.

In addition, the image removal promoting liquid (d) was allowed to stand for 3 days as it was. Then, toner images were formed on the copy paper and removed therefrom under the same conditions as mentioned above. As a result, image removal was carried out successfully.

When the toner images were again formed on the copy papers obtained by the above-mentioned recycling method, clear toner images were formed on any copy papers with good image-fixing properties.

EXAMPLE 5

A mixture of the following components was stirred and dissolved in a ball mill at 130° C.:

| | Wt. % |
|---|---|
| Rhodamine lake B | 3 |
| C.I. Solvent Red 49 | 0.5 |
| Beeswax | 48 |
| Paraffin wax | 10 |
| Stearic acid amide | 36.3 |
| Vinyl acetate/ethylene copolymer (with a molecular weight of about 3000) | 1.8 |
| 2-t-butyl-4-methoxyphenol | 0.38 |
| 3-t-butyl-4-methoxyphenol | 0.02 |

The above prepared mixture was subjected to centrifugal separation to remove rough particles, so that a hot-melt ink composition (C) was obtained.

A mixture of the following components was stirred and dissolved, so that an image removal promoting liquid (e) of the present invention was obtained:

| | Wt. % |
|---|---|
| Polyoxyalkylene-modified siloxane | 3 |
| Sodium percarbonate | 0.1 |
| Sodium sorbate | 0.1 |
| Diethylene glycol monobutyl ether | 30 |
| Pure water | 66.8 |

The hot-melt ink composition (C) was supplied to a head of the on-demand type hot-melt ink-jet printer using a conventional piezoelectric element. With the temperature of the head being controlled to 120° C., images were formed on a commercially available high quality paper ("PPC Paper type-6200" Trademark, made by Ricoh Company, Ltd.).

Then, the ink images thus formed on the high quality paper were removed therefrom by the same method as employed in Example 1 except that the image removal promoting liquid (a) set in the apparatus in Example 1 was replaced by the image removal promoting liquid (e). As a result, the high quality paper free from deposited ink image was obtained.

In addition, the image removal promoting liquid (e) was allowed to stand for 3 days as it was. Then, ink images were formed on the high quality paper and removed therefrom under the same conditions as mentioned above. As a result, image removal was carried out successfully.

When the ink images were again formed by using the same hot-melt ink-jet printer on the high quality papers obtained by the above-mentioned recycling method, clear ink images were formed on any high quality papers with good image-fixing properties.

EXAMPLE 6

A mixture of the following components was stirred and dissolved, so that an image removal promoting liquid (f) of the present invention was obtained:

| | Wt. % |
|---|---|
| Sodium dihexyl sulfosuccinate | 1 |
| Polyvinyl alcohol | 0.5 |
| Sodium benzoate | 0.1 |
| Diethylene glycol | 7 |
| Glycerin | 3 |
| Pure water | 88.4 |

Ink images were formed on a commercially available high quality paper by the same method as employed in Example 5.

Then, the ink images thus formed on the high quality paper were removed therefrom by the same method as employed in Example 5 except that the image removal promoting liquid (e) set in the apparatus in Example 5 was replaced by the image removal promoting liquid (f), and the material for the image release roller 302 was changed from PET to polycarbonate. As a result, the high quality paper free from deposited ink image was obtained.

In addition, the image removal promoting liquid (f) was allowed to stand for 3 days as it was. Then, ink images were formed on the high quality paper and removed therefrom under the same conditions as mentioned above. As a result, image removal was carried out successfully. When the ink images were again formed by using the same hot-melt ink-jet printer on the high quality papers obtained by the above-mentioned recycling method, clear ink images were formed on any high quality papers with good image-fixing properties.

EXAMPLE 7

A mixture of the following components was stirred and dissolved, so that an image removal promoting liquid (g) of the present invention was obtained:

| | Wt. % |
|---|---|
| Sodium dihexyl sulfosuccinate | 0.5 |
| Branched polyoxyethylene alkyl ether based surfactant | 0.5 |
| Sodium dehydroacetate | 0.1 |
| Carboxymethylcellulose (CMC) | 0.2 |
| n-methyl-2-pyrrolidone | 5 |
| Pure water | 93.7 |

Using a commercially available electrophotographic copying machine, toner images were formed on a commercially available high quality paper ("PPC Paper type-6200" Trademark, made by Ricoh Company, Ltd.) by the same method as employed in Example 1.

Then, the toner images thus formed on the copy paper were removed therefrom by the same method as employed in Example 1 except that the image removal promoting liquid (a) set in the apparatus in Example 1 was replaced by the image removal promoting liquid (g) and the material for use in the image release roller 302 was changed from PET to polyimide. As a result, the copy paper free from deposited toner image was obtained.

In addition, the image removal promoting liquid (g) was allowed to stand for 3 days as it was. Then, toner images were formed on the copy paper and removed therefrom under the same conditions as mentioned above. As a result, image removal was carried out successfully.

When the toner images were again formed on the copy papers obtained by the above-mentioned recycling method, clear toner images were formed on any copy papers with good image-fixing properties.

Comparative Example 1

The procedure for preparation of the image removal promoting liquid (a) as employed in Example 1 was repeated except that diethylene glycol for use in the formulation for the image removal promoting liquid (a) in Example 1 was not employed.

Thus, a comparative image removal promoting liquid (h) was obtained.

Using a commercially available electrophotographic copying machine, toner images were formed on a commercially available high quality paper ("PPC Paper type-6200" Trademark, made by Ricoh Company, Ltd.) by the same method as employed in Example 1.

Then, the toner images thus formed on the copy paper were removed therefrom by the same method as employed in Example 1 except that the image removal promoting liquid (a) set in the apparatus in Example 1 was replaced by the comparative image removal promoting liquid (h).

As a result, the toner images were removed from the copy paper satisfactorily.

However, when the image removal promoting liquid (h) was allowed to stand for 3 days as it was, and then used to remove the toner images formed on the copy paper, the image removal promoting liquid (h) was not applied to the toner-image-deposited copy paper uniformly, so that the donor images were not completely peeled from the copy paper.

Comparative Example 2

The procedure for preparation of the image removal promoting liquid (b) as employed in Example 2 was repeated except that triethylene glycol for use in the formulation or the image removal promoting liquid (b) in Example 2 was not employed.

Thus, a comparative image removal promoting liquid (i) was obtained.

Using a commercially available electrophotographic copying machine, toner images were formed on a commercially available high quality paper ("PPC Paper type-6200" Trademark, made by Ricoh Company, Ltd.) by the same method as employed in Example 2.

Then, the toner images thus formed on the copy paper were removed therefrom by the same method as employed in Example 2 except that the image removal promoting liquid (b) set in the apparatus in Example 2 was replaced by the comparative image removal promoting liquid (i).

As a result, the toner images were removed from the copy paper satisfactorily.

However, when the image removal promoting liquid (i) was allowed to stand for 3 days as it was, and then used to remove the toner images formed on the copy paper, there occurred the problem that the copy paper was no separated from the transporting roller 202 after the application of the image removal promoting liquid (i) to the copy paper.

Comparative Example 3

The procedure for preparation of the image removal promoting liquid (c) as employed in Example 3 was repeated except that 1,2,3-butanetriol for use in the formulation for the image removal promoting liquid (c) in Example 3 was not used.

Thus, a comparative image removal promoting liquid (j) was obtained.

Using a commercially available electrophotographic copying machine, toner images were formed on a commercially available high quality paper ("PPC Paper type-6200" Trademark, made by Ricoh Company, Ltd.) by the same method as employed in Example 3.

Then, the toner images thus formed on the copy paper were removed therefrom by the same method as employed in Example 3 except that the image removal promoting liquid (c) set in the apparatus in Example 3 was replaced by the comparative image removal promoting liquid (j).

As a result, it was observed that the surface portion of the copy paper was peeled therefrom after the recycling process.

When the image removal promoting liquid (j) was allowed to stand for 3 days as it was, and then used to remove the toner images formed on the copy paper, the surface portion of the copy paper was further peeled therefrom. Thus, toner images were not removed from the copy paper satisfactorily.

Comparative Example 4

The procedure for preparation of the image removal promoting liquid (e) as employed in Example 5 was repeated except that diethylene glycol monobutyl ether far use in the formulation for the image removal promoting liquid (e) in Example 5 was not used.

Thus, a comparative image removal promoting liquid (k) was obtained.

Using a commercially available on-demand type hot-melt ink-jet printer, ink images were formed on a commercially available high quality paper ("PPC Paper type-6200" Trademark, made by Ricoh Company, Ltd.) by the same method as employed in Example 5.

Then, the ink images thus formed on the high quality paper were removed therefrom by the same method as employed in Example 5 except that the image removal promoting liquid (e) set in the apparatus in Example 5 was replaced by the comparative image removal promoting liquid (k), As a result, it was observed that the surface portion of the copy paper was peeled therefrom after the recycling process.

When the image removal promoting liquid (k) was allowed to stand for 3 days as it was, and then used to remove the ink images formed on the high quality paper, the surface portion of the paper was further peeled therefrom. Thus, ink images were not removed from the high quality paper satisfactorily.

Comparative Example 5

The procedure for preparation of the image removal promoting liquid (f) as employed in Example 6 was repeated except that diethylene glycol and glycerin for use in the formulation for the image removal promoting liquid (f) in Example 6 were not used.

Thus, a comparative image removal promoting liquid (1) was obtained.

Ink images were formed on a commercially available high quality paper by the same method as employed in Example 6.

Then, the ink images thus formed on the high quality paper were removed therefrom by the same method as employed in Example 6 except that the image removal promoting liquid (f) set in the apparatus in Example 6 was replaced by the comparative image removal promoting liquid (1).

As a result, it was observed that the surface portion of the high quality paper was peeled therefrom after the recycling process.

When the image removal promoting liquid (1) was allowed to stand or 3 days as it was, and then used to remove the ink images formed on the high quality paper, the surface portion of the paper was further peeled therefrom. Thus, ink images were not removed from the high quality paper satisfactorily.

According to the present invention, as previously explained, the water component of the image removal promoting liquid can be prevented from evaporating in the course of the image removal process, so that the deposited images can be removed from the recording material more steadily without impairing the surface portion of the recording material. Because of the improvement in image removal performance, a variety of image-deposited recording materials can be subjected to the recycling method of the present invention regardless of the kind of image-constituting material or the kind of recording material.

It is possible to prevent the evaporation of water component of the image removal promoting liquid during a short period of intermission because the image removal promoting liquid of the present invention comprises a wetting agent. Therefore, the change of composition of the image removal promoting liquid can be prevented for several days, thereby preventing the decrease of the image removal performance. Namely, the storage stability of the image removal promoting liquid can be improved according to the present invention.

When the wetting agent for use in the image removal promoting liquid comprises at least one compound selected from the group consisting of a polyhydroxy alcohol, and an alkyl ether derivative and an aryl ether derivative thereof; a carboxylic acid with hydroxyl group, and a salt thereof; and a nitrogen-containing heterocyclic compound, and such a wetting agent is added in an amount of 0.5 to 60 wt. % of the total weight of the image removal promoting liquid, the effects gained by the image removal promoting liquid of the present invention can be maximized.

When the image removal promoting liquid of the present invention further comprises a surfactant, the wettability of the image-deposited recording material by the image removal promoting liquid and the penetration of the image removal promoting liquid into the image-deposited recording material can be improved. Accordingly, the image removal performance can be further upgraded. With the addition of a water-soluble polymer to the image removal promoting liquid, the image removal performance can be also improved, and the condition of the recording material after the recycling process can be improved.

Furthermore, the image removal performance can be further improved when the penetrating rate of the image removal promoting liquid into the image-deposited recording material is controlled to 10 ml/m$^2$ or more provided that the contact time (t) of the image removal promoting liquid with the recording material is 0.4 sec, and the deposited images are removed from the recording material in a temperature range from the softening point of the image-constituting material or more to a temperature less than the melting point thereof.

As previously explained, the condition of the recording material after the recycling process according to the present invention is better than that of the conventional recycled recording material. Therefore, the recording material can be used repeatedly in good condition. In addition, the operation, control and maintenance of the apparatus for recycling the image-deposited recording material can be made simple because the storage stability of the image removal promoting liquid is improved and the reliability of the image removal performance is increased.

Japanese Paten Application No. 06-125710 filed May 16, 1994 and Japanese Patent Application No. 06-162856 filed Jun. 21, 1994 are hereby incorporated by reference.

What is claimed is:

1. A method for recycling an image-deposited recording material comprising a surface portion which swells in contact with a water-containing liquid composition and bears thereon deposited images comprising an image-constituting thermoplastic or thermofusible material, comprising the steps of:

(a) applying a water-containing image removal promoting liquid composition to said image-deposited surface portion of said recording material to cause said surface portion of said recording material to swell more than said image-constituting material, thereby weakening the adhesion between said deposited images and said recording material; and (b) removing said deposited images from said recording material by using image release means;

said image removal promoting liquid comprising a wetting agent which exhibits an equilibrium moisture content of 10% or more under the ambient conditions of 60% relative humidity and 25° C., wherein said wetting agent is selected from the group consisting of a nitrogen-containing heterocyclic compound selected from the group consisting of N-methyl-2-pyrrolidone and 2-pyrrolidone and a polyhydric alcohol selected from the group consisting of ethylene glycol, diethylene glycol and glycerin.

2. The method for recycling said recording material as claimed in claim 1, wherein the amount of said wetting agent is in a range of 0.5 to 60 wt. % of the total weight of said liquid composition.

3. The method for recycling said recording material as claimed in claim 1, wherein said liquid composition further comprises a surfactant and/or a water-soluble polymer.

4. The method for recycling said recording material as claimed in claim 1, wherein the penetrating rate of said liquid composition into said image-deposited recording material is controlled to 10 $ml/m^2$ or more provided that the contact time (t) of said liquid composition with said recording material is 0.4 sec.

5. The method for recycling said recording material as claimed in claim 1, wherein said deposited images are removed from said recording material by bringing an image release member into contact with said deposited images with the application of heat and/or pressure thereto to cause said deposited images to transfer to said image release member.

6. The method for recycling said recording material as claimed in claim 5, wherein said deposited images are removed from said recording material in a temperature range from the softening point of said image-constituting material or more to a temperature less than the melting point thereof.

* * * * *

UNITED STATES PATENT AND TRADEMARK OFFICE

CERTIFICATE OF CORRECTION

PATENT NO. : 5,736,286
DATED : APRIL 7, 1998
INVENTOR(S) : TETSUYA KANEKO, ET AL.

It is certified that error appears in the above-identified patent and that said Letters Patent is hereby corrected as shown below:

Column 10, line 3 "other" should read --of the--.

Column 18, line 31 "donor" should read --toner--.

Column 18, line 38 "or" should read --for--.

Column 19, line 25 "far" should read --for--.

Column 20, line 5 "or" should read --for--.

Column 21, line 6 "Paten" should read --Patent--.

Signed and Sealed this

Twelfth Day of January, 1999

*Attest:*

*Attesting Officer*

*Acting Commissioner of Patents and Trademarks*